US008633370B1

(12) United States Patent
Raley et al.

(10) Patent No.: US 8,633,370 B1
(45) Date of Patent: Jan. 21, 2014

(54) CIRCUITS TO PROCESS MUSIC DIGITALLY WITH HIGH FIDELITY

(75) Inventors: K. Paul Raley, Lawrenceville, GA (US); Howard A. Carnes, Suwanee, GA (US)

(73) Assignee: PRA Audio Systems, LLC, Lawrenceville, GA (US)

( * ) Notice: Subject to any disclaimer, the term of this patent is extended or adjusted under 35 U.S.C. 154(b) by 403 days.

(21) Appl. No.: 13/134,327

(22) Filed: Jun. 4, 2011

(51) Int. Cl.
*G10H 1/00* (2006.01)

(52) U.S. Cl.
USPC ..... 84/743; 84/723

(58) Field of Classification Search
USPC ..... 84/723, 745
See application file for complete search history.

(56) References Cited

U.S. PATENT DOCUMENTS

| | | | | |
|---|---|---|---|---|
| 6,894,214 | B2 * | 5/2005 | Juszkiewicz | 84/609 |
| 7,714,222 | B2 * | 5/2010 | Taub et al. | 84/600 |
| 7,838,755 | B2 * | 11/2010 | Taub et al. | 84/609 |
| 8,035,020 | B2 * | 10/2011 | Taub et al. | 84/600 |
| 8,153,878 | B2 * | 4/2012 | Chevreau et al. | 84/609 |
| 8,296,134 | B2 * | 10/2012 | Teo et al. | 704/225 |
| 8,509,692 | B2 * | 8/2013 | Ryle et al. | 455/41.3 |
| 2002/0007719 | A1 * | 1/2002 | Hasegawa | 84/609 |
| 2004/0069119 | A1 * | 4/2004 | Juszkiewicz | 84/609 |
| 2004/0094020 | A1 * | 5/2004 | Wang et al. | 84/622 |
| 2004/0134334 | A1 * | 7/2004 | Baggs | 84/723 |
| 2004/0144241 | A1 * | 7/2004 | Juskiewicz et al. | 84/723 |
| 2005/0039594 | A1 * | 2/2005 | Dubal | 84/737 |
| 2007/0131100 | A1 * | 6/2007 | Daniel | 84/737 |
| 2008/0034950 | A1 * | 2/2008 | Ambrosino | 84/742 |
| 2008/0047416 | A1 * | 2/2008 | Cummings | 84/731 |
| 2008/0190271 | A1 * | 8/2008 | Taub et al. | 84/645 |
| 2008/0190272 | A1 * | 8/2008 | Taub et al. | 84/645 |
| 2008/0257130 | A1 * | 10/2008 | Kammerer | 84/291 |
| 2008/0276794 | A1 * | 11/2008 | Juszkiewicz et al. | 84/742 |
| 2010/0212478 | A1 * | 8/2010 | Taub et al. | 84/645 |
| 2011/0088536 | A1 * | 4/2011 | McMillen et al. | 84/746 |
| 2012/0266740 | A1 * | 10/2012 | Hilbish et al. | 84/645 |
| 2013/0034240 | A1 * | 2/2013 | Crawford | 381/77 |
| 2013/0112069 | A1 * | 5/2013 | Weinreich et al. | 84/731 |
| 2013/0156207 | A1 * | 6/2013 | Visser et al. | 381/57 |
| 2013/0208923 | A1 * | 8/2013 | Suvanto | 381/122 |

* cited by examiner

*Primary Examiner* — David S. Warren
(74) *Attorney, Agent, or Firm* — F. Russell Denton; Denton Intellectual Property Law Firm, LL

(57) ABSTRACT

The present invention provides a complementary bifurcated circuit to process and optimize music digitally with high fidelity yet with wireless elements. In a particular embodiment, an audio transducer in close proximity to a musical instrument or vocalist's mouth transforms audible music to analog electrical signals, which are digitized and then filtered to remove external noise at the frequencies of alternating current as well as internally generated noise. A FPGA encoder optimizes the signal's latency and formats the signal for wireless transmission, which is then accomplished with a transmitter and receiver. A transmitter control interface programs one or more of the digital encoder, digital processor, FPGA encoder and wireless transmitter. The signal received wirelessly at a remote location is stripped of formatting by a FPGA decoder, corrected to remove nonlinearities in amplification, further optimized for sound latency, and amplified as needed to drive an external audio apparatus such as a loud speaker, mixing board, or professional recording device. A receiver control interface programs one or more of a receiver, FPGA decoder, digital audio CODEC, and digital audio amplifier. The invention is particularly well suited for stringed instruments but is not so limited.

20 Claims, 10 Drawing Sheets

Block diagram illustrating an embodiment of a circuit according to the invention.

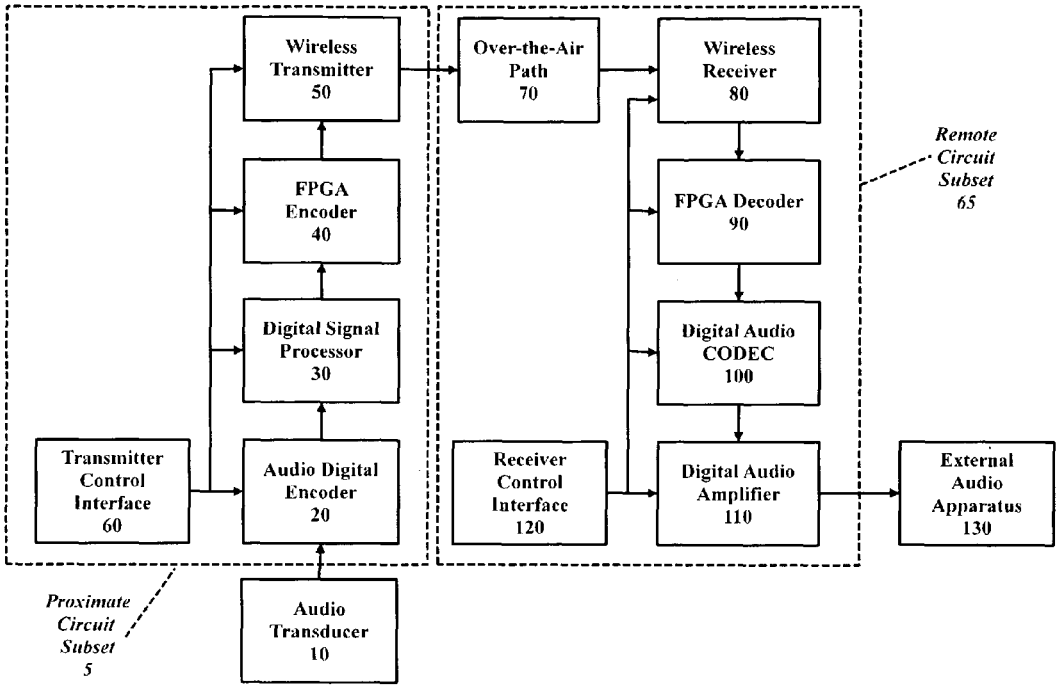
Figure 1: Block diagram illustrating an embodiment of a circuit according to the invention.

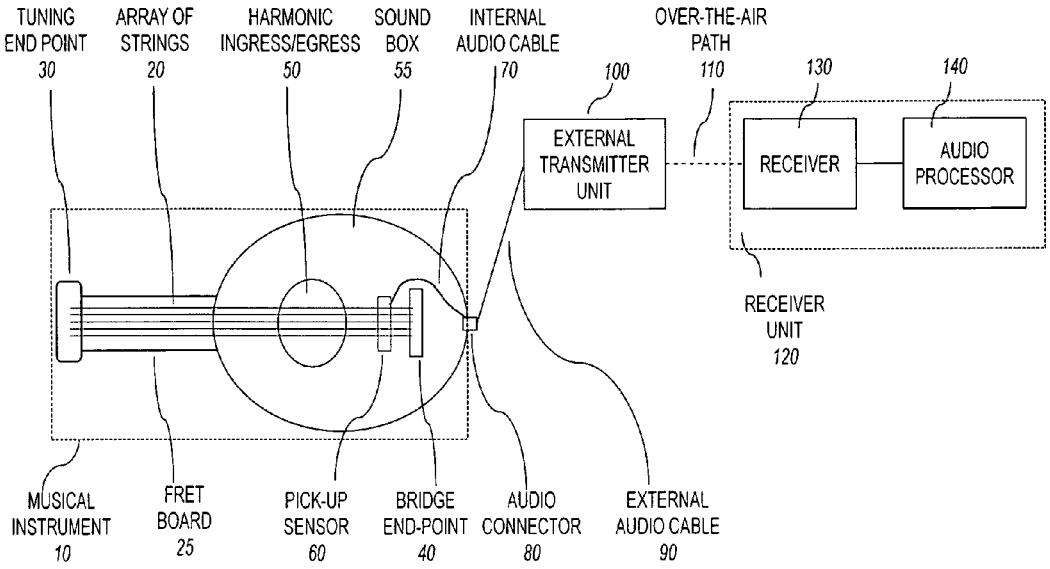
Figure 2: Caricature of an illustrative embodiment of the invention in which an external transmitter unit is in line with a pick-up sensor on a musical instrument.

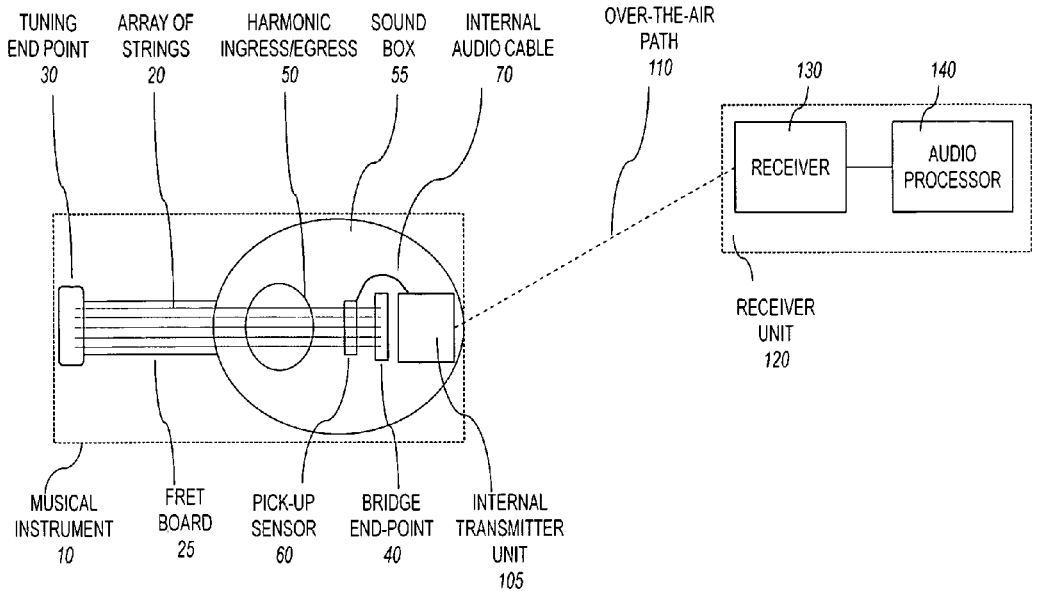
Figure 3: Caricature of an illustrative embodiment of the invention in which an on-board transmitter unit is in line with a pick-up sensor on a musical instrument.

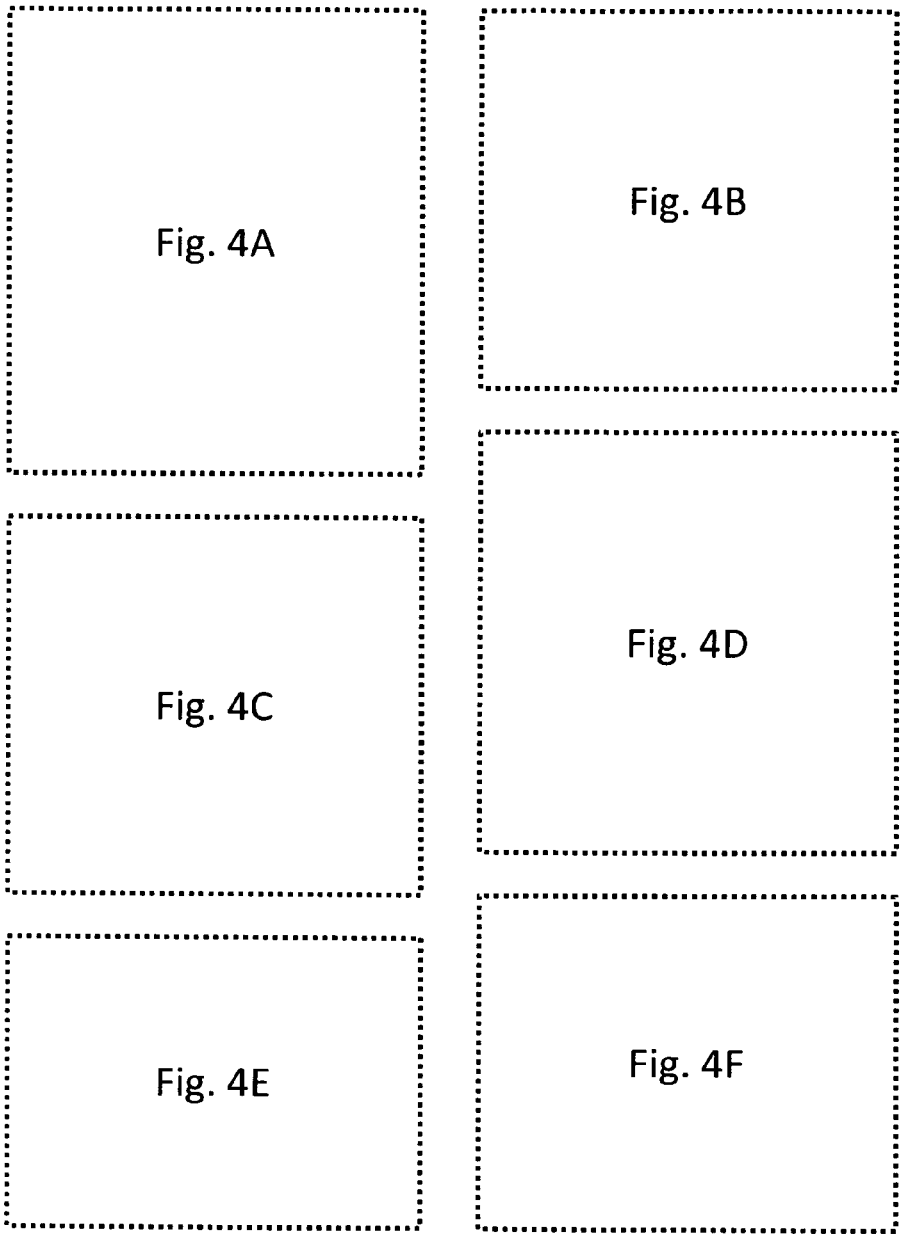
Fig. 4 shows an illustrative embodiment of the invention that has been made and shown to work as described herein, depicted piecewise as shown above.

CIRCUITS TO PROCESS MUSIC DIGITALLY WITH HIGH FIDELITY

FIELD OF THE INVENTION

The present invention relates to circuits comprising wireless components, for use in high fidelity audio processing of musical performances.

BACKGROUND OF THE INVENTION

The diverse electronic technologies that are currently used to amplify and record professional performances on musical instruments suffer from a variety of critical deficiencies. The most problematic deficiencies concern noise ingress, internally generated noise, nonlinear amplitude response, audio dynamic range, frequency response and audio time latency, all of which affect the quality and fidelity of the music. This is especially a challenge for processing sound from stringed instruments, as discussed below. However, many of the same deleterious electronic phenomena affect other types of instruments as well.

Noise ingress arises in stringed instruments when electrically powered equipment radiates an un-programmed radiofrequency or even audio-range signals as a result of electromagnetic fields that are an incidental and unwanted byproduct of their circuit designs. The resulting ambient signals are received by the electronic audio pickup components in the instruments, and compromise their output. The problem has been universal because electronic equipment is ubiquitously and prolifically present in musical performance environments, and because electronic shielding to prevent such emanations is often absent or grossly inadequate. The issue is further complicated by a much older phenomenon in purely acoustic instruments wherein ambient noise in the audible range enters a harmonic cavity and echoes there, such as in a wind instrument, stringed instrument or percussion instrument.

Externally generated signals are not the only source of noise. The instruments may have undesirable resonances, and the instruments' own complement of in-line electronics can also contribute. There such noise is generated internally and is then layered undesirably onto the desired audio sound. Linear audio equipment in particular is a source of this.

In addition to noise, other artifacts arise from intrinsically flawed sound engineering hardware, causing distortion of the sound. In particular, nonlinear amplitude responses are inherent in the analog amplification elements that are widely used in present art electronic amplification devices. In this case amplification from the devices does not scale proportionally with the magnitude of an instrument's actual amplitude output. Thus non linear elements introduce signal components that do not emanate from the instrument.

Nonlinear scale changes for volume have a parallel in truncation of the dynamic sound range. The dynamic range refers to the extent of difference between the loudest possible sounds and quietest possible sounds conveyed in the output: larger ranges permit more nuanced expression in the music. To date the dynamic range of analog audio signals that can be handled electronically has been limited, because as the voltage of a sound control component approaches that of the power supply, thermal noise and analog signal compression become substantial. Vacuum tubes are currently in favor to improve the feasibly attainable dynamic range, but these have their own disadvantages: limited availability, limited mobility, and very high voltage requirements.

Just as the dynamic sound range is often truncated, audio apparatus often attenuate or overemphasize certain frequency bands relative to other frequency ranges. The audio frequency response quantifies the electronic ability to reproduce relative amplitudes (as measured from input to output) uniformly across a frequency spectrum. The inhomogeneous propagation of magnitudes across frequency spectra may be accompanied by phase changes (measured in radians) in the analog signal, which also differ depending on the frequency, again distorting the sound. These flaws are common in electronic amplification, microphones and loudspeakers, and phase shifts commonly arise from capacitive reactance or inductive reactance in their components.

Some hardware-derived artifacts occur along an additional dimension: they introduce unintended delays in the processing and transmittal time during which sound is delivered through the circuit. Audio latency is the duration between the time an instrumental sound is made and the time when it actually leaves the speaker. Latencies within a certain range have been proven to be disorienting to the human brain. Research studies have also shown that the perception of optimal latency levels varies between individuals. (See Michael Lester and Jon Boley, "The Effects of Latency on Live Sound Monitoring", *Audio Engineering Society Convention Paper* 7198, Presented at the 123$^{rd}$ Convention 2007 (October 5-8), New York, N.Y.) It is counterintuitive, and in some cases impossible, yet zero time is not always the ideal for perceived optimal latency. Thus the latency level must be taken to a middle ground that satisfies the most listeners. Sources of latency increases include analog-to-digital conversion, buffering, digital signal processing, transmission time, digital-to-analog conversion and the speed of sound.

In order to minimize these various effects, the current state of the art links stringed instruments to electronic audio equipment by means of wire cables. This has been a very imperfect solution. The cables hamper musicians' freedom of motion, are subject to electrical noise interference, have a high initial cost and must be replaced frequently. Moreover even use of cables has not been able to circumvent the above problems entirely. Wireless connections have been used as an alternative, but they require frequency modulation that is subject to radiofrequency interference and noise, and for recording sessions their bandwidth and dynamic range may be limited.

Thus there is an ongoing need for improved methods and devices to process musical performance with high fidelity.

BRIEF DESCRIPTION OF THE DRAWINGS

FIG. 1 shows a caricature of an illustrative embodiment of the invention, providing an electronic system configuration wherein sound generated with a stringed instrument is converted to digital form, transmitted wirelessly, received and further processed.

FIG. 2 shows a caricature of an illustrative embodiment of the invention, wherein an onboard portion of the digital processing system is attached but physically external to a stringed instrument.

FIG. 3 shows a caricature of an illustrative embodiment of the invention, wherein an onboard portion of the digital processing system is attached to and is physically present both internally and externally on a stringed instrument.

SUMMARY OF THE INVENTION

Figure 4A:
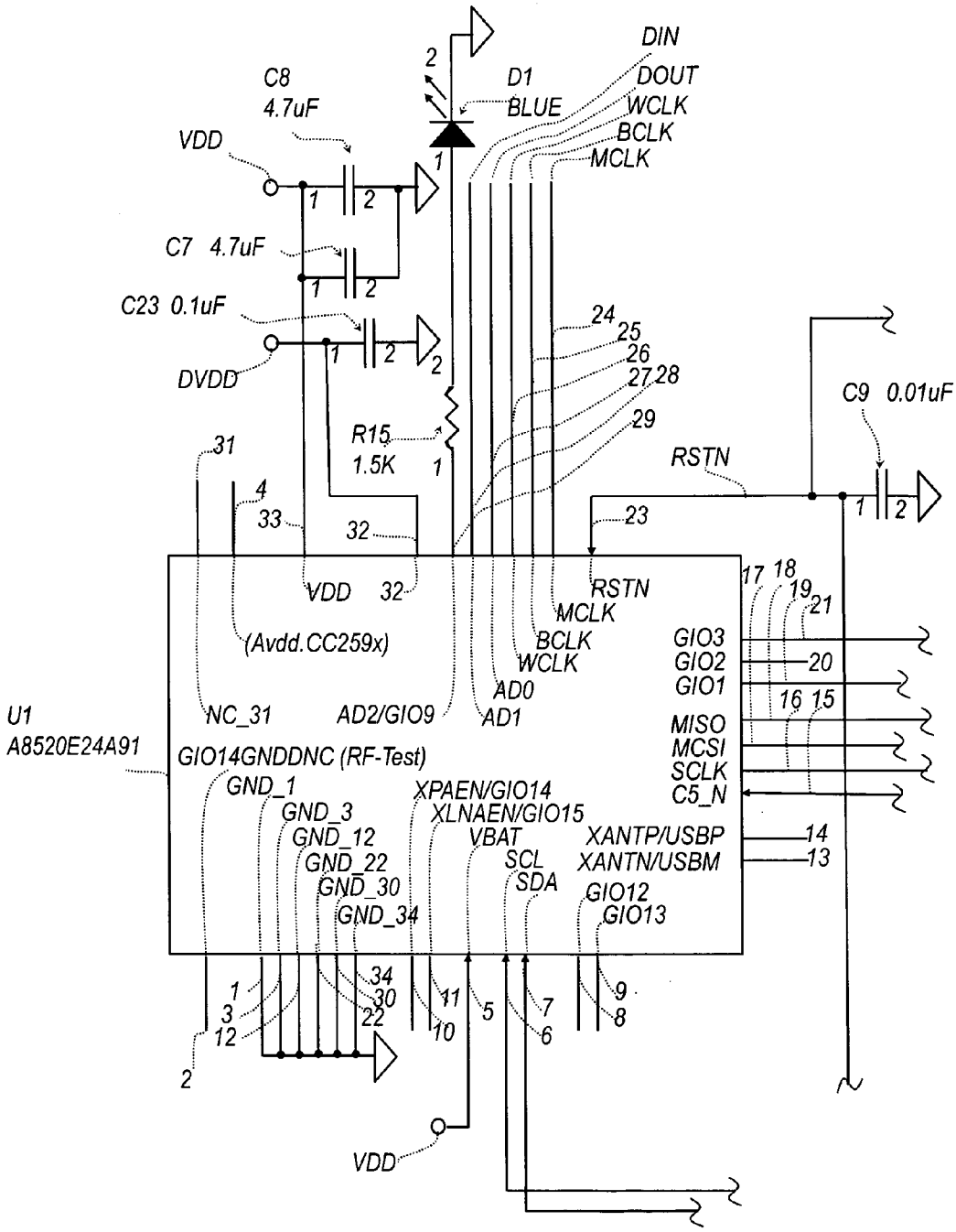
FIG. 4 shows a caricature of a detailed circuit diagram for an illustrative embodiment of the invention that has been made and shown to work as described herein.

The present invention provides electronic systems for high fidelity amplification of sound from musical instruments and vocal performances. In particular it provides improved control and optimization with respect to noise ingress, internally generated noise, audio frequency response, nonlinear amplitude response, dynamic sound range and audio latency. The invention allows for settings to be programmed for each of those parameters.

In a particular embodiment the invention is a complementary bifurcated circuit to process music digitally with high fidelity, wherein the circuit comprises:

(a) an audio transducer that is located in close proximity to a musical instrument or a vocalist's mouth;

(b) a proximate circuit subset comprising:

(i) an audio digital encoder that is in electronic communication with the audio transducer;

(ii) a digital signal processor that is in electronic communication with the audio digital encoder;

(iii) a field programmable gate array encoder that is in electronic communication with the digital signal processor;

(iv) a wireless transmitter that is in electronic communication with the field programmable gate array encoder; and (v) a transmitter control interface that comprises a microcontroller and that is in electronic communication with one or more of the audio digital encoder, digital signal processor, field programmable gate array encoder and wireless transmitter;

(c) a remote circuit subset comprising:

(i) a wireless receiver that is in wireless communication with the proximate circuit subset's wireless transmitter along an over-the-air path;

(ii) a field programmable gate array decoder that is in electronic communication with the wireless receiver;

(iii) a digital audio CODEC that is in electronic communication with the field programmable gate array decoder;

(iv) a digital audio amplifier that is in electronic communication with the digital audio CODEC; and (v) a receiver control interface that comprises a microcontroller and that is in electronic communication with one or more of the wireless receiver, field programmable gate array decoder, digital audio CODEC and digital audio amplifier; and (d) an external audio apparatus that is in electronic communication with the digital audio amplifier of the remote circuit subset.

In a further embodiment the invention is a complementary bifurcated circuit to process music digitally with high fidelity, wherein the circuit comprises:

(a) an audio transducer that is located in close proximity to a performing instrument or a vocalist's mouth, and that is configured to transform audible music into analog electrical signals;

(b) a proximate circuit subset comprising:

(i) an audio digital encoder that is in electronic communication with the audio transducer, and that is configured to transform analog electrical signals into digital electrical signals;

(ii) a digital signal processor that is in electronic communication with the audio digital encoder, and that is programmed to serve as a notch filter for a sampled audio digital stream to sharply attenuate the amplitude of frequency ranges associated with alternating current from power sources and to filter out unwanted internally generated noise from the instrument;

(iii) a field programmable gate array encoder that is in electronic communication with the digital signal processor, and that is programmed to optimize a sampled audio digital stream by modifying its sound latency, adding digital timing information, and formatting the digital stream for wireless transmission;

(iv) a wireless transmitter that is in electronic communication with the field programmable gate array encoder, and that is configured to transform a sampled audio digital stream input to a wireless signal for high fidelity reception by a wireless receiver; and (v) a transmitter control interface that comprises a microcontroller, and that is in electronic communication with and provides programming and control for each of the audio digital encoder, digital signal processor, field programmable gate array encoder and wireless transmitter;

(c) a remote circuit subset comprising:

(i) a wireless receiver that is in wireless communication with the proximate circuit subset's wireless transmitter along an over-the-air path;

(ii) a field programmable gate array decoder that is in electronic communication with the wireless receiver, and that is programmed to modify a sampled audio digital stream by removing its formatting for wireless transmission;

(iii) a digital audio CODEC that is in electronic communication with the field programmable gate array decoder, and that is programmed in one or both of the following ways:

(A) the digital audio CODEC is programmed to modify a sampled audio digital stream's binary audio intensity in specific incremental audio frequency bands, to render the binary audio intensity essentially equal across the entire audio spectrum; or (B) the digital audio CODEC is programmed to insert a programmed delay in a sampled audio digital stream by routing the stream in a reiterative loop between an electronic output and electronic input of the CODEC until the stream reaches a desired degree of latency;

(iv) a digital audio amplifier that is in electronic communication with the digital audio CODEC, and that is programmed to increase the coded sound intensity to a level desired for an external audio apparatus that is in line with the remote circuit subset; and (v) a receiver control interface that comprises a microcontroller, and that is in electronic communication with and provides programming and control for each of the wireless receiver, field programmable gate array decoder, digital audio CODEC and digital audio amplifier; and (d) an external audio apparatus that is in electronic communication with the digital audio amplifier of the remote circuit subset.

DETAILED DESCRIPTION OF THE INVENTION

The invention may be further understood by the following description and illustrations. The definitions below clarify the scope of terms used for that purpose herein.

DEFINITIONS

The term "musical instrument" has its usual and ordinary meaning, and includes stringed instruments, brass instruments, woodwind instruments, percussion instruments, keyboard instruments, and others. The term musical instrument as used herein is not limited by the musical key, range or modality for which an instrument is designed, modified, tuned or played.

The term "stringed instrument" has its usual and ordinary meaning, and includes all manner of stringed instruments, including but not limited to guitars, bass guitars, mandolins, fiddles, harps, violins, violas, violoncellos, contrabasses, and double basses, among others. The term stringed instrument as used herein includes both acoustic instruments and electric instruments, for instance it includes both acoustic guitars and electric guitars.

The term "brass instrument" has its usual and ordinary meaning, and includes all manner of brass instruments, including but not limited to French horns and other horns, trumpets, cornets, trombones, tubas, Wagner tubas, euphoniums, helicons, mellophones, sousaphones, alphorns, serpents, conches, ophicleides, didgeridoos, shofars, Vladimirskiy rozhoksm and vuvuzelas, among others. The term brass instrument as used herein follows the usual musical convention for the classification, i.e., it does not depend upon whether the instrument actually is made of brass, but is based upon the fact that the sound is produced by vibration of air in a tubular resonator in sympathy with the vibration of the player's lips. The term brass instrument as used herein includes but is not limited to valved brass instruments, slide brass instruments, so-called natural brass instruments, and keyed or fingered brass instruments.

The term "woodwind instrument" has its usual and ordinary meaning, and includes all manner of woodwind instruments, including but not limited to piccolos, flutes, oboes, English horns, clarinets, bass clarinets, bassoons, contrabassoons, saxophones, and harmonicas, among others.

The term "percussion instrument" has its usual and ordinary meaning, and includes all manner of percussion instruments, including but not limited to timpani, snare drums, tenor drums, bass drums, cymbals, tam-tams, triangles, wood blocks, tambourines, glockenspiels, xylophones, vibraphones, chimes, marimbas, and hand bells, among others.

The term "keyboard instrument" has its usual and ordinary meaning, and includes all manner of keyboard instruments, including but not limited to pianos, organs, celestas, harpsichords, electric pianos, electric organs, synthesizers, accordions, melodeons, Russian bayans, other free-reed aerophones such as concertinas, aeolas, edeophones, and the like.

The term "voice," "vocal," and "vocals" as used with respect to human song and speech have their respective usual and ordinary meaning in music, and refer to the vocal component of a musical performance.

The term "instrumentals" refers to the component of a musical performance that arises from the use of one or more musical instruments.

The term "performance" refers to performance of any type of music for either an audience, studio recording or other purpose, where the performance has vocal and or instrumental elements.

The term "recording" refers to the act of making an audio reproduction of a musical performance, and to the audio reproduction that results from a recording event. The term recording is used herein includes optionally processing the musical sounds to optimize them in any desired fashion.

The term "noise ingress" refers to sound that is generated when electrically powered equipment radiates unprogrammed radiofrequency and or audio-range signals as a result of electromagnetic fields that are an incidental and unwanted byproduct of their circuit designs, to the extent that the resulting ambient sound is received by an electronic audio pickup component at an instrument and or at a vocal microphone.

The term "internal noise" refers to undesired sound that is generated when electrically powered equipment radiates unprogrammed radiofrequency and or audio-range signals as a result of electromagnetic fields that are an incidental and unwanted byproduct of the circuit design of a musical instrument's own in-line electronics. The electronics generating internal noise may be intrinsic to the instrument's construction, as in an electric guitar. Alternatively the electronics generating internal noise may be in a complementary circuit, as in a removable pick-up circuit that has been placed on an acoustic guitar. Linear audio equipment in particular is a source of internal noise.

The term "nonlinear amplitude response" refers to electronic amplification that varies in a disproportional way as the actual amplitude changes during a performance.

The terms "binary audio intensity" and "coded sound intensity" refer to the amplitude of sound as encoded in an audio digital stream.

The term "dynamic sound range" refers to the extent of difference between the loudest possible sounds and quietest possible sounds that are conveyed when a performance is recorded or when it is amplified for an audience.

The term "audio frequency response" refers to the relative uniformity of electronic reproduction of amplitudes across a frequency spectrum. The term is used when input amplitudes as actually produced by a performance are compared to output amplitudes from electronic equipment that amplify and or record the performance. Inhomogeneous propagation of magnitudes across frequency spectra are sometimes accompanied by phase changes (measured in radians) in the analog signal, and these may also differ depending on the frequency. Common sources of non-homogeneity are electronic amplifiers, microphones and loudspeakers. Common sources of the phase shifts are capacitive reactance or inductive reactance in circuit components.

The term "audio frequency band" refers to a subset of audible frequency spectrum. The term "incremental audio frequency band" refers to a narrow range within the audible frequency spectrum.

The term "audio latency" refers to the duration between the time an instrumental sound is made during a performance and the time when it leaves an electronic speaker after passing through an electronic circuit. Such latency is often detectable by a listener and may detract from the perceived quality of a performance or recording. Some common sources of latency increases include analog-to-digital conversion, buffering, digital signal processing, transmission time, digital-to-analog conversion and the speed of sound.

The terms "proximate circuit" and "proximate circuit subset" refer to electronic circuits that are within, upon, juxtaposed with, or otherwise located very near to an instrument or vocalist's mouth during a musical performance.

The terms "remote circuit" and "remote circuit subset" refer to electronic circuits that are located sufficiently far apart that wireless communications along an over-the-air-path between them are both feasible and advisable, yet sufficiently near to one another that desired audio latency ranges and other aspects of sound fidelity can be achieved reliably. In certain embodiments the over-the-air path distance between a performer's wireless transmitter and a separate respective wireless receiver is in the range of 5 feet to 200 feet.

The term "audio transducer" refers to a transducer used for the purpose of converting sound waves from an instrumental and or vocal performance to signals of another type of energy, or vice versa. Suitable transducers include but are not limited to piezoelectric, electrical, electro-mechanical, electromagnetic, and photonic transducers.

The term "in electrical communication" as used in respect to two electrical components refers to their mutual presence on the same circuit, wherein one or both components is able to receive electrical current that has passed through the other.

The term "transmitter control interface" (TCI) refers to an interface that is programmed with stored instructions by means of a microcontroller unit (MCU), and that is in electrical communication with one or more of an audio digital encoder, a DSP, a FPGA encoder, and a wireless transmitter. In certain illustrative, non-limiting embodiments the TCI comprises a serial peripheral interface (SPI). In alternative illustrative, non-limiting embodiments the TCI comprises an inter-integrated circuit (I2C).

The term "programming" refers to providing instructions to a component or to a circuit subset. The term programming includes but is not limited to: programming of settings by a user, such as for the settings of a microcontroller; programming of other electronic components in a circuit by a microcontroller located on that circuit; and the like. The term "control" refers to management of electrical or electronic signals by monitoring them, routing them, switching electronic components on or off, modifying attributes of the signals, or the like.

The term "programmed delay" refers to delaying an electrical or electronic signal so that its end-to-end time in passing through a circuit falls within a preferred range. The programmed delay may be achieved by cycling the signal through data registers in a repetitive fashion (i.e., in a reiterative loop) or by other means.

The term "configured" as used herein with respect to a respective electronic component refers to a combination of factory settings for the respective component, user-adjusted settings for the component or a controller driving it, and inter-circuit relationships for electrical communication between the respective component and other hard-wired electronic components.

The term "audio digital encoder" refers to a component that is capable of transforming analog audio signals into digital signals, optionally under the control of stored instructions from a microcontroller. The terms "audio digital stream" and "sampled audio digital stream" refer to electrical signals arising from the digitization of analog electrical signals.

The term "digital signal processor" (DSP) refers to a component that is capable of editing digital signals, optionally under the control of stored instructions from a microcontroller. By editing is meant that suitable digital signal processors are capable of deleting, amending, adding to, coding, decoding, compressing and decompressing digital signals.

The term "FPGA encoder" refers to a field programmable gate array that adds information to a digital electrical signal to prepare it for wireless transmission. The term "formatting for wireless transmission" refers to that addition of information for such a purpose.

The term "wireless" as used herein with respect to transmissions of signals along an over-the-air-path refers to wireless telecommunications. Wireless transmission modalities contemplated by the invention include but are not limited to radiofrequency transmissions, infrared transmissions, visual optical transmissions, microwave transmissions, and ultrasonic transmissions.

The term "in wireless communication" refers to the passage of wireless signals along an over-the-air-path between a first circuit having a wireless transmitter and a second circuit having a wireless receiver. The term "wireless transmitter" refers to a transmitter for a wireless modality. The term "wireless receiver" refers to a receiver for a wireless modality. In some embodiments of the invention wireless communications may be transmitted in both directions: in that case when wireless signals are sent in the reverse direction the receiver functions as a transmitter and vice versa.

The term "over-the-air path" refers to a transmission path through a medium such as air, along which wireless communications may be transmitted.

The term "FPGA decoder" refers to a field programmable gate array that removes information from a wirelessly received digital electrical signal to prepare it for processing that will restore it to audio form.

The term "digital audio CODEC" refers to an algorithm or component that can encode information from an analog audio signal as digital electrical signals, and or that can decode a digital electrical signal to prepare it for transformation to an analog waveform. In some embodiments it contains both an ADC and a DAC running off the same clock, as in a sound card.

The term "external audio apparatus" refers to a device for playing or processing sound from a musical performance. As used herein the term includes but is not limited to amplifiers, mixing boards, loud speakers, head phones, recording devices, other engineering devices for sound quality adjustment, and the like.

With reference to stringed instruments the terms used herein have the following meanings. The term "array of strings" refers to a plurality of strings. In certain embodiment an array of strings comprises five to twelve strings. The term "bridge end point" refers to a location on a stringed instrument at which the strings are anchored. The term "tuning end point" refers to a location on a stringed instrument at which the strings are drawn taut to achieve a respective pitch for each string. The term "fret board" refers to an oblong solid over which strings are stretched and upon which they may be held down to modulate the respective resonant frequencies of the strings when plucked.

With reference to stringed instruments the terms used herein have the additional following meanings. The term "sound box" refers to a hollow harmonic chamber underneath the platform defined by the upper surface of the instrument. The terms "harmonic ingress/egress" refers to an orifice defined by the top surface of the sound box. The term "sound board" refers to a stringed instrument's platform defined by the upper surface of the instrument but lacking a hollow cavity.

The term "on board" refers to electrical and electronic components that are held on or near to an instrument's surface or a vocalist's mouth. The term on board includes but is not limited to components that are integrated into the construction of an instrument.

The term "pickup sensor" refers to an audio transducer.

The term "internal audio cable" refers to an audio cable between a pick-up sensor and internal (i.e., on-board) transmitter unit or audio connector. The term internal as used with respect to the audio cable indicates that it is on board the instrument, not that it is necessarily an intrinsic part of the instrument's construction.

The term "transmission line" has its usual meaning in electrical engineering.

The term "audio connector" refers to a coupling between an internal audio cable and an external (e.g., pendant on the instrument) audio cable.

The term "external audio cable" refers to an audio cable between an audio connector and external (e.g., pendant on the instrument) transmitter unit.

The term "transmitter unit" is synonymous with wireless transmitter.

The term "receiver" is synonymous with wireless receiver.

The term "high fidelity reception" as used herein refers to wireless reception of an encoded audio signal in a manner that is sufficiently complete and predictable that the signal can be decoded and transformed to faithfully reproduce audible sound from its original source.

The term "audio processor" refers to a peripheral device serving one or more functions such as amplifying sound, recording a performance, modifying digital signals for music, or the like.

The term "receiver unit" refers to a circuit comprising a receiver and an audio processor.

Circuit Design

Figure 4B:
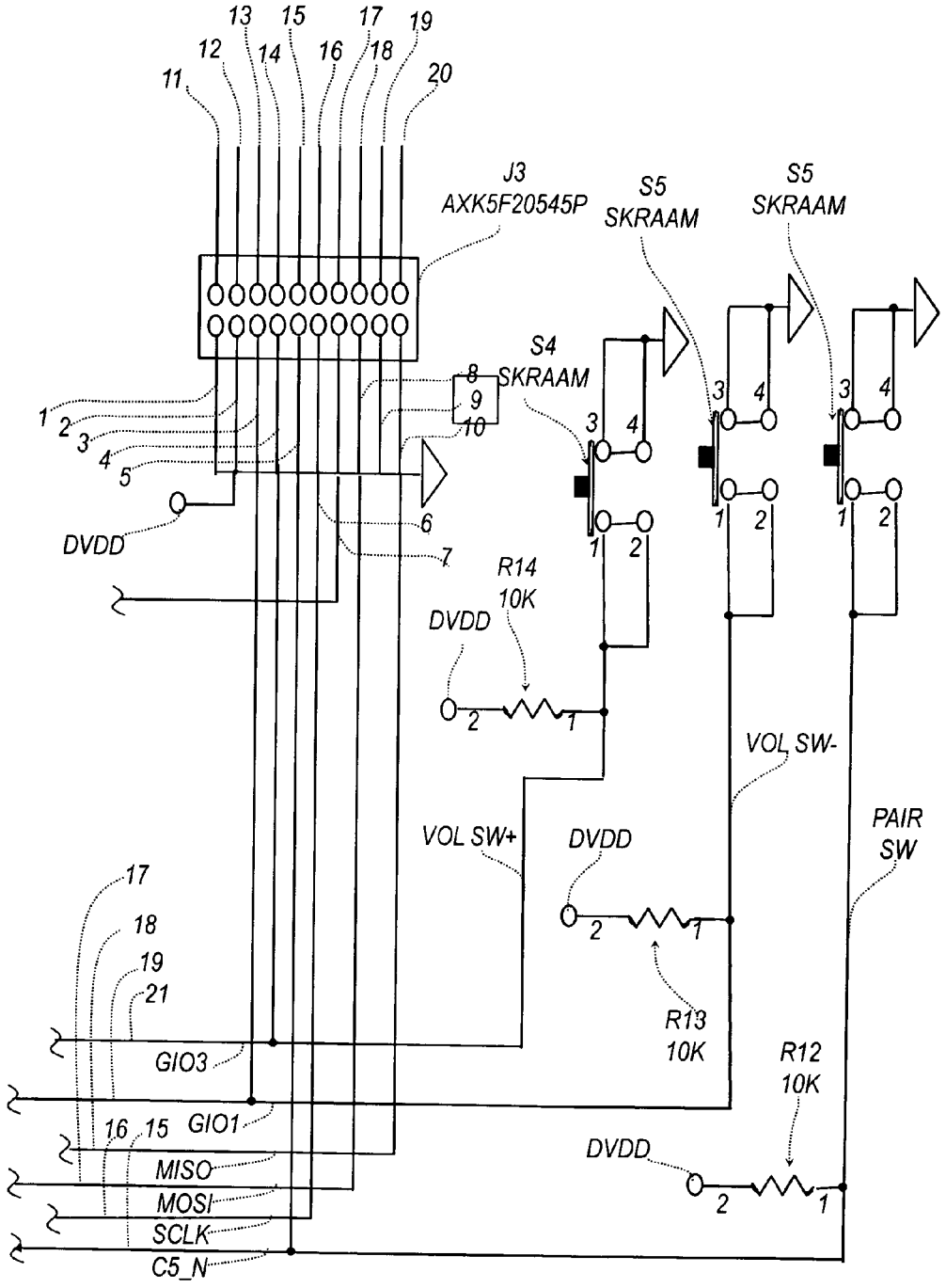
Figure 4C:
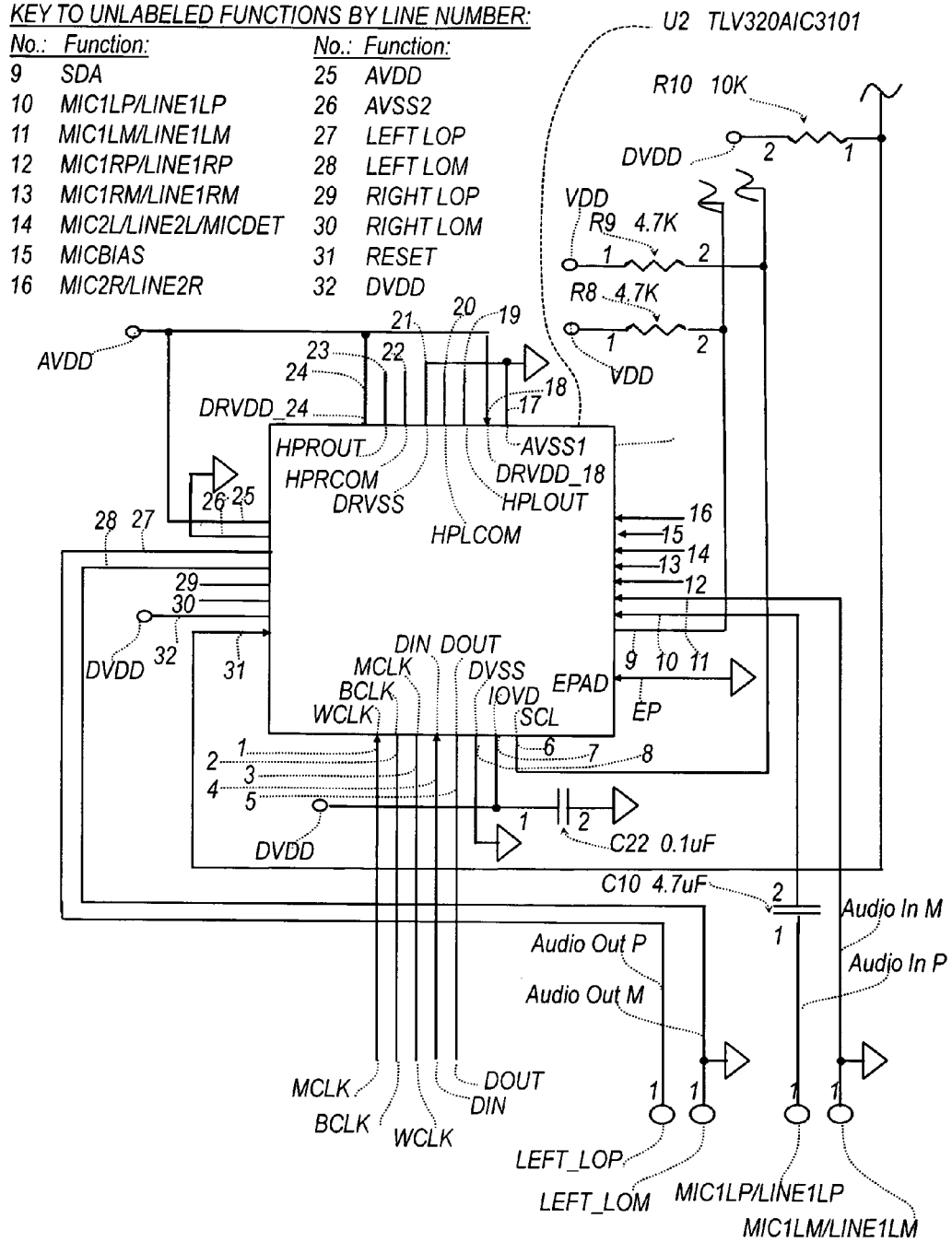
Figure 4D:
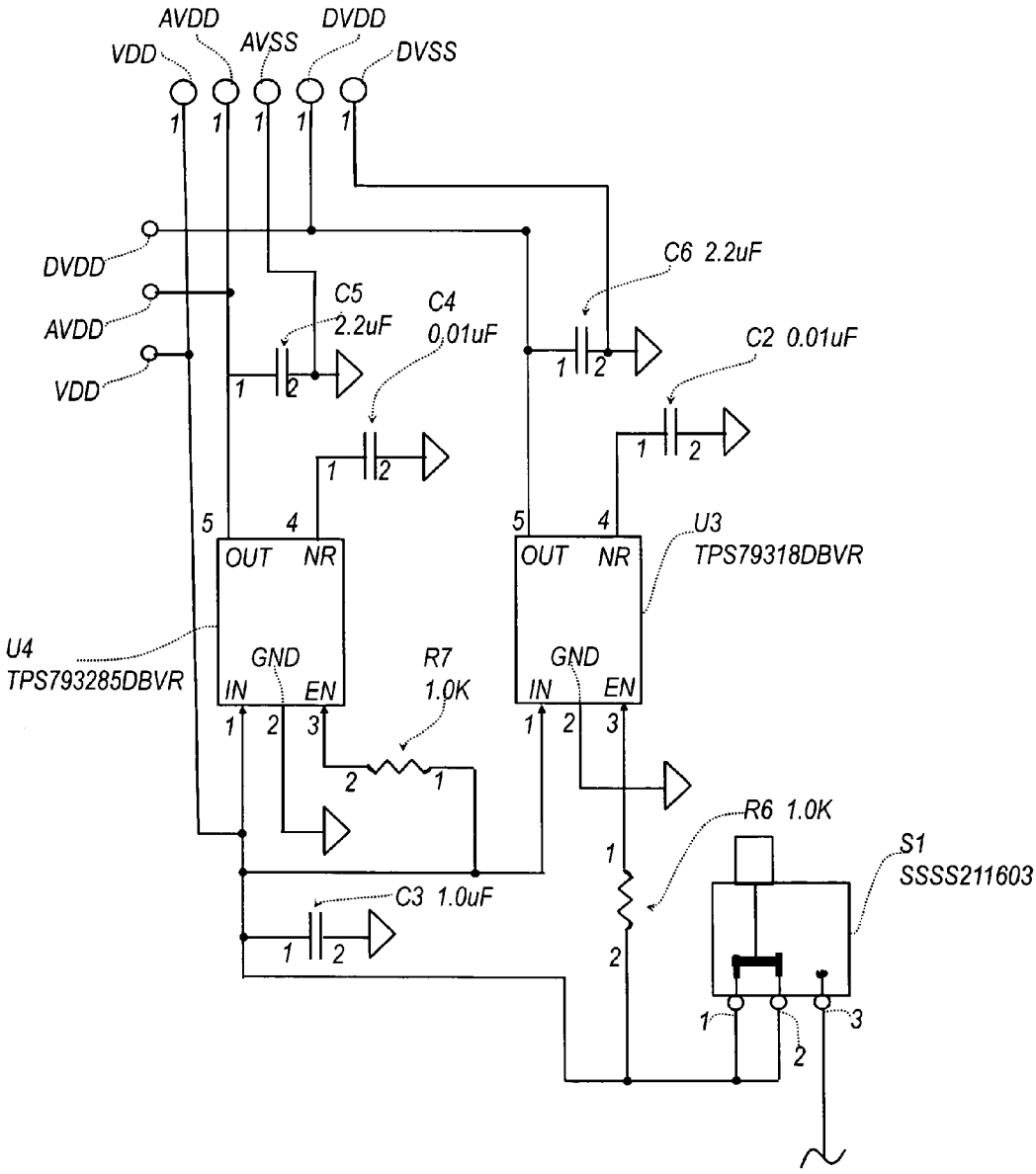
Figure 4E:
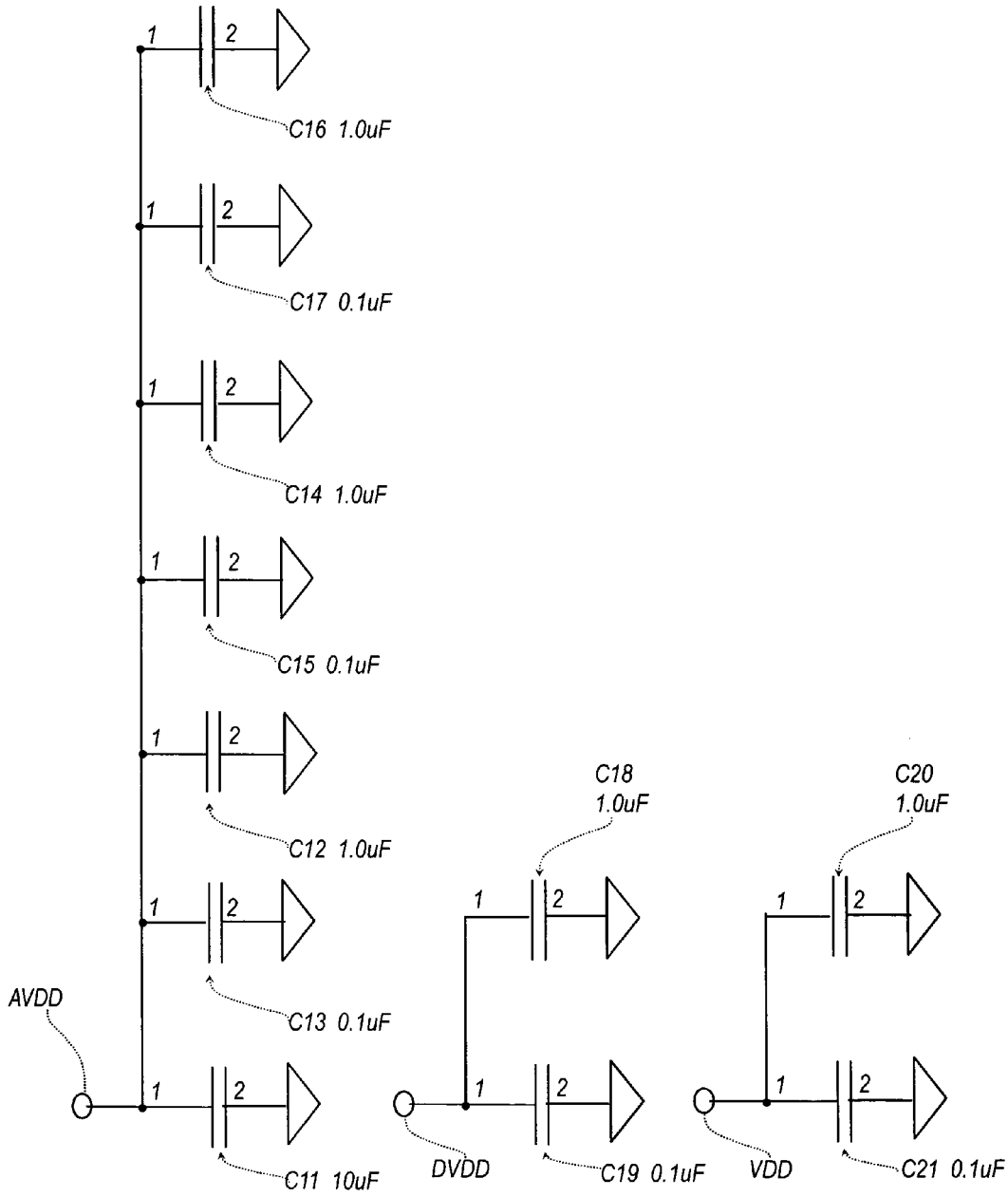
Figure 4F:
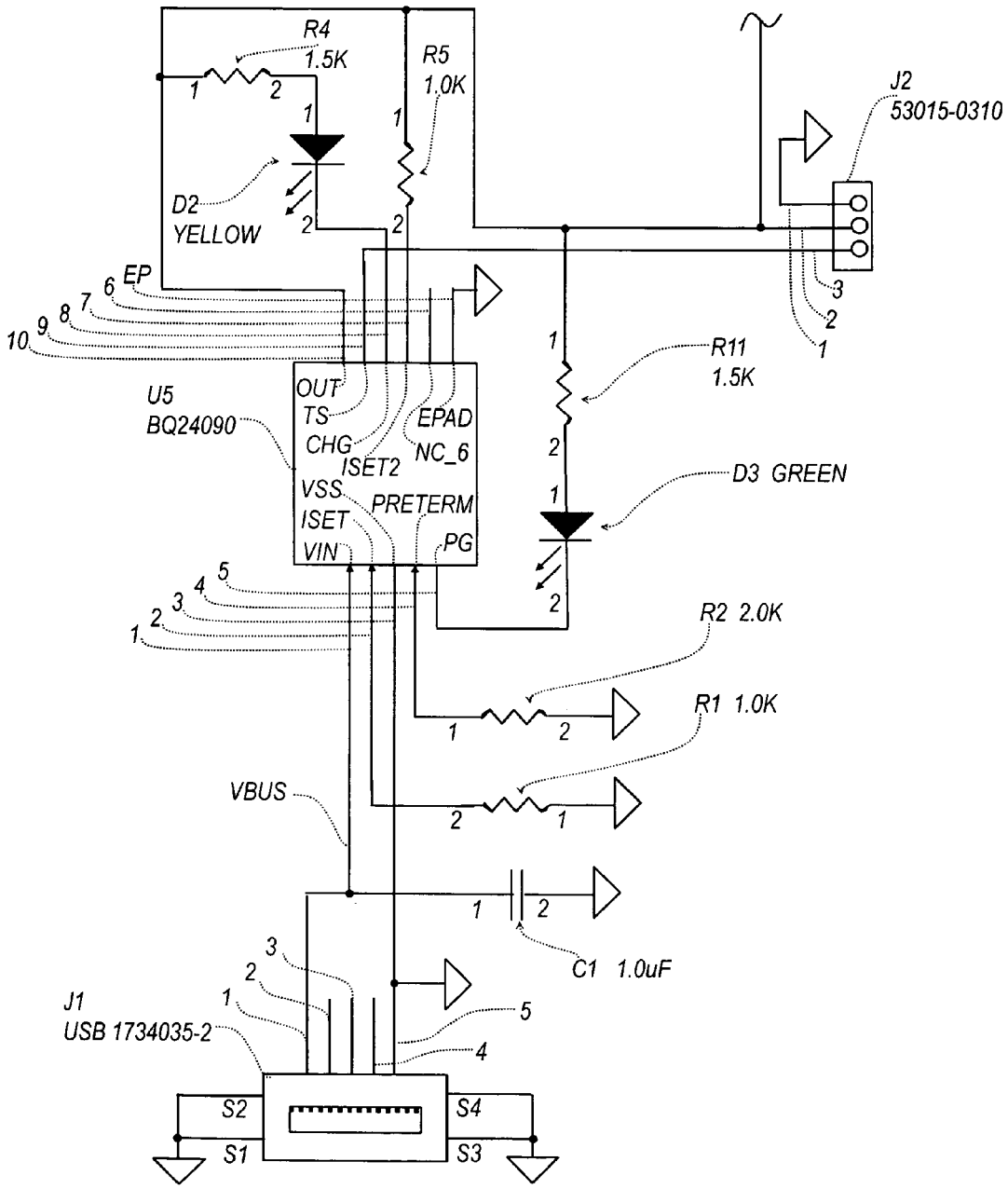

In the broad scheme of circuit designs according to the invention, an audio transducer (10) on a musical instrument is in electrical communication with a proximate digital processing module, in which the electrical signal is processed and encoded, then transmitted as corresponding wireless signals on a path over the air. The wireless signal is received by a remote digital module, which in turn decodes and processes the signal, and is in electrical communication with an external audio apparatus (130). The Figures provide illustrative embodiments of the invention. The block diagram of FIG. 1 provides an illustrative logic paradigm for circuits according to the invention. FIGS. 2 and 3 illustrate use of the invention for stringed instruments in particular but it is not so limited. FIG. 4 provides a detailed circuit diagram for a successful functioning embodiment of the invention that has been made and tested.

FIG. 1 shows an audio transducer (10) in electrical communication with an audio digital encoder (20), which in turn is in electrical communication with a digital signal processor (30), which in turn is in electrical communication with an FPGA encoder (40), which in turn is in electrical communication with a wireless transmitter (50). In this embodiment a transmitter control interface (60) is in electrical communication with each of components (20), (30), (40) and (50). The transmitter control interface (60) is in wireless communication along an over-the-air path (70) with a wireless receiver (80). The wireless receiver (80) is in electrical communication with an FPGA decoder (90), which in turn is in electrical communication with a digital audio CODEC (100), which in turn is in electrical communication with a digital audio amplifier (110). In this embodiment a receiver control interface (120) is in electrical communication with each of components (80), (90), (100) and (110). The digital audio amplifier (110) is in electrical communication with an external audio apparatus (130). The circuit as a whole is bifurcated principally between a proximate circuit subset (5) and a remote circuit subset (65), the boundaries of each of which is defined in the schematic by broken lines. The proximate circuit subset (5) is located within, attached upon, juxtaposed with or otherwise very near a musical instrument or a musically performing mouth of a vocalist. The remote circuit subset (65) receives one or more signals from the proximate circuit subset by radiofrequency, optical transmissions, microwaves, or otherwise wirelessly.

Examples of illustrative, particularly useful operating parameters for the electronic components in FIG. 1 are as follows, however this list is not exclusive. Appropriate ranges for these parameters are discussed later in this application. Control parameters for the audio digital encoder (20) are bit depth and sample rate, both with controlled variability. Control parameters for the DSP (30) are the operational frequency values and the desired amplitude gain or loss, optionally including sharp attenuation of amplitude at 50-60 Hz for use in U.S. venues. Control parameters for the FPGA encoder (40) and FPGA decoder (90) are the desired end-to-end signal latency times in the circuit. Control parameters for the CODEC (100) are: the operational frequency values; the desired amplitude gain or loss (optionally greatly attenuated at 50-60 Hz for use in U.S. venues); and other settings that may be used as desired from prior state of the art, such as volume level control, sound reverberation effects, and linear emphasis or deemphasis of audio frequency bands.

FIG. 2 shows a mechanical view of certain embodiments of the invention. A musical instrument (10) has an array of strings (20) held taut and attached to the instrument by a tuning end point (30) and a bridge end point (40), wherein the strings are located in part above a fret board (25) and in part above a sound box (55) and optionally above a harmonic ingress/egress (50) orifice defined by the top surface of the sound box. The strings optionally are tuned and optionally are vibrating. For a stringed instrument in which the sound box does not define a hollow cavity, the component 55 may represent a sound board. A pickup sensor (60) is affixed to instrument (10), and positioned so as to sense vibration of strings (20) for conversion to an electrical signal. An "internal" audio cable (70) serves as a transmission line for electrical communication between the pickup sensor (60) and an audio connector (80). The term internal as used with respect to the audio cable indicates that it is on board the instrument, not that it is necessarily an intrinsic part of the instrument's construction. An external, e.g., pendant, audio cable (90) serves as a transmission line for electrical communication between the pickup sensor (60) and a transmitter unit (100). The transmitter unit conveys signal wirelessly through an over-the-air-path (110) to a receiver (130) in a receiver unit (120); the receiver (130) converts the wireless signal to an electrical signal and conveys it to an audio processor (140). The signal transmission along the over-the-air-path (110) may be by radiofrequency waves, optical transmissions, microwaves, or otherwise wirelessly.

FIG. 3 shows an alternative embodiment whereby a transmitter unit is located internally (i.e., on board and optionally integrated with) a stringed instrument. This embodiment may be affixed during the instrument's manufacture. In this embodiment, musical instrument (10) has an array of strings (20) held taut and attached to the instrument by a tuning end point (30) and a bridge end point (40), wherein the strings are located in part above a fret board (25) and in part above a sound box (55) and optionally above a harmonic ingress/egress (50) orifice defined by the top surface of the sound box. The strings optionally are tuned and optionally are vibrating. For a stringed instrument in which the body does not define a hollow cavity, the sound box 55 may represent a sound board. A pickup sensor (60) is affixed to instrument (10), and positioned so as to sense vibration of strings (20) for conversion to an electrical signal. An "internal" audio cable (70) serves as a transmission line for electrical communication between the pickup sensor (60) and an internal transmitter unit (105). The term internal as used with respect to the audio cable and or the transmitter indicates that the referenced component is on board the instrument, not that it is necessarily an intrinsic part of the instrument's construction. The internal transmitter unit (105) conveys signal wirelessly along an over-the-air-path (110) to a receiver (130) in a receiver unit (120); the receiver (130) converts the wireless signal to an electrical signal and conveys it to an audio processor (140). The signal transmission along the over-the-air-path (110) may be by radiofrequency, optical transmissions, microwaves, or otherwise wirelessly.

FIG. 4 shows a caricature of a detailed circuit diagram for an illustrative embodiment of the invention that has been made and shown to work as described herein.

The benefits of the general design of the circuit in removing electronic audio artifacts may be understood from the following summary. The invention applies digital signal processing at the ingress point of noise and frequency spectrum distortions, thereby improving audio quality and minimizing distortions. The output of the DSP is comprised of the original audio signals. The DSP greatly attenuates the 50-60 Hz frequency range of the output. Both this ingress noise (from alternating current) and the instrument's internally generated noise are sharply attenuated at the ingress/egress location.

The circuit stores operational parameters in the transmitter control interface (TCI) for components for which current flow actually precedes the actual wireless transmission. The parameter set determines the operational frequency values and the amplitude gain or loss. The circuit corrects the audio frequency response in a digital binary format at the DSP. It then transfers the improved signal to the FGPA Encoder (4), which inserts additional binary digital information to facilitate transmission over the air path.

Operational parameters are also stored in the receiver control interface (RCI) for refinement of the post-wireless audio data stream. These can rectify nonlinearities in amplification and can optimize latency. For control volume levels, sound reverberation effects, audio frequency band linear emphasis and linear de-emphasis, and power amplification persons of ordinary skill in audio electronics are already well aware of suitable circuits, components and methods. Note that although the RCI may be based on the same type of physical component as the TCI, the embedded firmware in an RCI's microcontroller will not be the same as in a TCI's microcontroller because the functions they support are distinct.

Circuit designs and methods are already known in the art for manipulating other types of sound attributes digitally. For example, Conexant's CX20709 device is a speaker-on-a-chip that transforms audible sound in stereo to analog electrical signals, converts the analog signals to digital bits, and sends the bits to a first direct memory access (DMA) component, which in turn routes them to memory. A user-programmable controller in the CX20709 serves several functions, including: programming a DSP for digital manipulation of the audio signals in the memory; maintaining control over the volume and voltage; controlling a USB CODEC device and a serial peripheral interface (SPI) with an inter-integrated circuit (I2C); and (through an intermediate second DMA) controlling inputs from pulse code modulation (i.e., sound sampling) by two integrated interchip sound (I2S) components. The modified bits in the memory then pass through a third DMA, are converted back to analog signals for stereophonic outputs, and finally the signal is converted back to audible music for a loudspeaker, earphones, class-D amplifier, or other peripheral device. See, e.g., www.conexant.com/servlets/DownloadServlet/PBR-202391-007.pdf?docid=2392&revid=7 and the contents thereof. Among several benefits claimed by Conexant for audio manipulation in the CX20709 are the following: cancelling sub-band acoustic echoes to eliminate speaker-to-microphone feedback; cancelling sub-band line echoes (in two-way intercoms) arising from twisted-pair crossover on a full duplex two-wire hybrid network; widening the sound output from narrowly separated speakers to achieve an immersive effect; and reducing speaker clipping; all with low power consumption.

The novelty of the instant invention over prior art sound manipulation may be further understood by reviewing its remedies for the artifacts addressed one by one. Note that the descriptions above and below omit certain aspects of circuit design such as the choice and configuration of the power supply, the computational clock and other components, but criteria for their specifications and selection are well known to practitioners of ordinary skill in the electronic arts.

Ingress Noise

Present day transducers for music are susceptible to strong interferences (noise) emanating from local power sources. For instance, lighting for a stage or studio commonly produces interferences in the 50 to 60 Hz range at U.S. venues. The present invention applies digital signal processing to attenuate power supply frequencies at the ingress point of noise and frequency spectrum distortions, thereby preempting their interference and sharply mitigating their effects. Thus a digital signal processor (30, hereafter abbreviated as DSP) is located at the ingress point of noise.

A non-limiting example of a DSP (30) that is suitable for this aspect of the invention is Texas Instruments component TLV320AIC3254, which is an audio CODEC with embedded DSP.

Internally Generated Noise

Internally generated noise arises from analog amplitude errors in the respective frequency band of the instrument's own internal electronics and or from imperfect instrument manufacturing and tuning. In each of these cases, after the noise originates it is then conveyed as an unwanted passenger in the train of electronic signals generated from the instrument itself The instant invention mitigates that problem by means of the DSP (30). The DSP's settings for this purpose are modified to optimize the match between the respective instrument or vocal and the desired output; the DSP then corrects the frequency response in a digital binary format.

The same DSP can be used to filter out both ingress noise and an instrument's internally generated noise, or a separate DSP may be used for each. In either case, a non-limiting example of a DSP (30) that is suitable for this aspect of the invention is again Texas Instruments component TLV320AIC3254.

Illustrative ranges for DSP settings are as follows. For guitars, the nominal frequency range for a pick-up sensor (i.e., for the audio transducer (10) in FIG. 1) is 5 Hz to 20 KHz. The primary amplitude response is from 0 volts rms to 1.5 volts rms. Amplified pick-up sensors can reach as high as 2 volts rms. The most common external noise to be filtered out is 60 Hz and at its discrete harmonics (120 Hz, 180 Hz, etc.). Not all internally generated harmonic responses are undesirable. Professional recording studios typically employ spectrum analyzers that display the audio frequency spectrum and the amplitudes across it, in order to damp amplitude artifacts manually. For the present invention the recording engineer would determine corrective parameters and download them to the DSP device by mean of a personal computer or other programmable device. Here the corrective parameters could be sent from the receiver to the transmitter or vice versa in order to program a DSP or controller.

Nonlinear Amplitude Response

Audio amplitude responses tend to be linear for only a fixed portion of their transfer function, i.e., the correlation between input and output becomes variable outside certain input values. Nonlinear amplitude response, also known as amplitude distortion, arises from one or both of two developments: the appearance of harmonics of a fundamental analog wave frequency from the input, and or the presence of intermodulation wherein two or more analog waves of different frequencies from the input are merged to generate several analog waves having several additional respective frequencies. Intermodulation effects are diminished in narrow-band systems because some of the artifact waves will fall outside the frequency range employed, but even there third-order distortion products can be problematic.

Devices according to the invention address this by means either or both of two modes. In the first mode operational parameters stored in the transmitter control interface (TCI, 60) are applied to instruct the DSP (30) regarding adjustment for amplitude gain or loss. In the second mode a digital audio CODEC (100) modulates volume level and sound reverberation under the control of a receiver control interface (RCI, 120), again based on stored operational parameters.

Non-limiting examples of suitable components for these circuits include the following. For the first mode's TCI (60), a wireless transmitter/receiver control interface could be a Silicon Laboratories C85051F126 microcontroller. For the first mode's DSP (30), an audio CODEC with embedded DSP, the Texas Instruments TLV320AIC3254 component. This may be the same DSP used to filter out ingress noise and or an instrument's internally generated noise, or may be a separate DSP. For the second mode's digital audio CODEC (100), an audio CODEC with embedded DSP, a Texas Instruments TLV320AIC3254 component. The DSP embedded on that CODEC may be the same or separate from the DSP used to filter out ingress noise and or an instrument's internally generated noise. For the second mode's RCI (120), a wireless transmitter/receiver control interface, an Anaren A8520E24A91 component.

Audio Dynamic Range

The signal's dynamic range in upstream processing elements is already improved by removing the 60 Hz noise ingress, however that is not the only improvement to dynamic range that the invention provides.

The transmitter control interface (TCI, 60) stores a set of operational parameters in an embedded memory. These parameters can be used to control and redirect the output from the audio digital encoder (20). A control parameter that can be used to control and optimize the audio dynamic range is the bit depth used when digitizing the audio output. The bit depth is the number of bits of information recorded for each sample of sound, and scales directly with the resolution of audio samples. Equipment in the current art employs a fixed bit depth, and thus does not accommodate intervention to manage the boundaries of the dynamic range. By controlling the bit depth and making it programmable or (if desired) variable at will, the invention enables better management of the output range.

Audio is typically recorded at 8-, 16-, or 20-bit depth. These values yield a theoretical maximum signal to quantization noise ratio (SQNR) for a pure sine wave of, respectively, 49.93 dB, 98.09 dB and 122.17 dB. However even high quality audio 8-bit depth has too much intrinsic and marked quantization noise (low maximum SQNR). CD quality audio is recorded at 16-bit depth: Consumer stereos tend to have at or under 90 dB of dynamic range, in part because thermal noise limits the true number of bits that can be used in quantization. 20-bit quantization is generally considered to be the highest level needed for practical audio hardware: few analog sources have signal to noise ratios (SNR) in excess of 120 dB, thus using more than 20-bit depth for their digitization would provide more resolution than the original analog sound has. Professional recording studios prefer to use even more stringent operational parameters—specifically 24 bit depth at a 96 KHz sampling rate—based on human auditory capacity. However the invention is not so limited, thus not only these but also other bit depths may be used, for instance, to customize the bit depth as a function of the quality of the dynamic range of the audio input or desired output fidelity.

Non-limiting examples of suitable components for these circuits include the following.

For the TCI (60), a wireless transmitter/receiver control interface, an Anaren A8520E24A91 component can suffice. For the audio digital encoder (20), a Texas Instrument TLV320AIC3101 component can suffice.

Audio Frequency Response

For frequency response management enriched resolution of the audio signal is helpful, which is obtained in devices according to the invention by means of an (adjustable) stored control parameter for the sampling rate. Equipment in the current art employs a fixed sampling rate, and thus does not accommodate intervention to set optimal frequency responses; consequently those devices cannot remedy defects in the audio frequency response with the aid of enhanced resolution from increased sampling rates.

Useful sampling rates are as follows. Typical high fidelity audio amplifiers must have an acceptable frequency response across the range of at least 20-20,000 Hz (the range of human hearing), with tolerances near ±0.1 dB in the mid-range frequencies around 1000 Hz. In order to capture this entire range, commonly used sampling rates are 44.1 kHz (CD) and 48 kHz (professional audio). Industry trends have been shifting to even higher sampling rates, such as 96 kHz and 192 kHz. The higher rates also capture the ultrasonic range: although that range is inaudible to humans, ultrasonic waves can mix with and thus modulate the audible frequency spectrum. The higher sampling rates also enable relaxing of low-pass filter designs for conversion from analog and digital signals, and back again.

Devices according to the invention provide for the transmitter control interface (60) to use a relevant stored control parameter to instruct the audio digital encoder (20) to sample at a higher rate. The resulting richer data source then becomes available for frequency response corrections by means of either or both of two components. The DSP (30) has a function for correcting the frequency response and amplitude gain or loss in a digital binary format to conform to the operational frequency values. But also, the digital audio CODEC (100) has a function for adjusting the audio frequency band emphasis and de-emphasis to refine the frequency response. A non-limiting examples of a suitable audio digital encoder/decoder (20) for these circuits is the Texas Instrument TLV320AIC3101 component. Either or both of the DSP (30) and the CODEC (100) can be used to optimize frequency response.

The same DSP that is used to filter out ingress noise and internally generated noise can also be used to optimize the frequency response. A non-limiting example of a suitable DSP (30) for these circuits is the Texas Instruments TLV320AIC3254 audio CODEC with embedded DSP. In general DSP operational parameters may be set with PC-based DSP design tools available from the specific manufacturer. The resulting code is downloaded from the design tool into a respective DSP in the invention by means of standard control ports on that DSP; but note that some CODEC devices have internal DSP sections.

Similarly, the same CODEC that is used to optimize the amplitude response can also be used to optimize the frequency response. A non-limiting example of a suitable CODEC for these circuits is Texas Instruments TLV320AIC3254, an audio CODEC with embedded DSP.

Audio Time Latency

Another stored control parameter in devices according to the present invention enables one or both of the transmitter control interface (TCI, 60) and receiver control interface (RCI, 120) to dictate the audio time latency. In this case, the parameter specifies an adaptive delay by the FPGA Encoder (40) and or FPGA Decoder (90), where FPGA is an acronym for field programmable gate array. Conventional wisdom for professional audio recording and entertainment venues recommends a latency of 5 milliseconds. Recent research studies report that listener-preferred latencies are actually between 2 and 40 milliseconds, depending on the type of instrument. For instance, the researchers found that for stringed instruments listener-preferred latencies are between 5 and 13 milliseconds. In one embodiment of the present invention the receiver control interface (120) controls the latency of the FPGA decoder (90) by means of instructions routing the digital binary audio data stream through data registers from the current art, using a stored, optionally variable operational parameter. I.e., in that embodiment the invention provides a controlled amount of latency by utilizing variable data buffers.

The same TCI (60) that is used to optimize audio dynamic range may also be used to optimize the audio time latency because these interfaces use standard device programming. An example of a TCI that is suitable for this purpose is the serial peripheral interface (SPI); an alternative example is the inter-integrated circuit (I2C). The TCI has a microcontroller unit (MCU) component; a non-limiting illustrative example of a suitable MCU is Silicon Laboratories' MCU no. C8051F126; the respective data sheet including programming parameters are available, for instance, at http://www.wvshare.com/datasheet/SILABS_PDF/C8051F126.PDF.

The RCI may employ the same type of component as the TCI, though of course the two interfaces will be separate. Moreover, the same RCI that is used to optimize the amplitude response may also be used to optimize the audio time latency. As for the TCI, an example of an interface that is suitable as an RCI is the serial peripheral interface (SPI); an alternative example is the inter-integrated circuit (I2C). Similarly the RCI has a MCU component also; here, too, a non-limiting illustrative example of a suitable MCU is Silicon Laboratories' MCU no. C8051F126.

The FPGA components are digital, and frame (40) each binary audio sample before transmission and de-frame (90) them afterward. FPGA components commonly also insert a pre-transmission coding byte so as to identify and correct errors when de-framing: errors arise from poor signal-to-noise ratios in wireless transmission. A non-limiting example of a suitable FGPA encorder is Xilinx's device no. XC7A8 in the Artix-7 series; its data sheet is available at http://www.xilinx.com/support/documentation/data_sheets/ds180__7Series_Overview.pdf. In a particular embodiment of the invention an FPGA Encoder inputs an audio sample (24 bits long) and concatenates a frame code that indicates either the first least significant bit or the last significant bit of the audio sample word. Note that because typical framing of audio samples begins with either the first or last significant bit for transmission, naturally the receiving end of the transmission must employ the corresponding convention for receiving and de-framing them in order to be completely correct. Each sample is sent serially on an RF carrier over the wireless link to a companion receiver. In a further embodiment the FPGA's encoding as provided has minimal overhead information, thereby minimizing the latency. The target end-to-end latency (i.e., the latency between the origin of performance sound and the exit point from an amplifier or speaker) for a particular embodiment for stringed instruments is between 5 msec and 12 msec.

As for the encoders, a non-limiting example of a suitable FGPA decorder is Xilinx's device no. XC7A8 in the Artix-7 series. An FPGA Decoder inputs modulated RF from the companion wireless transmitter of known frequency, detects the Bit 1 audio sample, and outputs a copy of the audio as sent by the Wireless Transmitter. The decoder detects the frame code to identify the current Bit 1 audio sample. Again, or still, the target end-to-end latency is between 5 msec and 12 msec.

The embodiments of the invention as described herein are merely illustrative and are not exclusive. Numerous additions, variations, derivations, permutations, equivalents, combinations and modifications of the above-described composition and methods will be apparent to persons of ordinary skill in the relevant arts. The invention as described herein contemplates the use of those alternative embodiments without limitation.

What is claimed is:

1. A complementary bifurcated circuit to process music digitally with high fidelity, wherein the circuit comprises:

(a) an audio transducer that is located in close proximity to a musical instrument or a vocalist's mouth;

(b) a proximate circuit subset comprising:

(i) an audio digital encoder that is in electronic communication with the audio transducer;

(ii) a digital signal processor that is in electronic communication with the audio digital encoder;

(iii) a field programmable gate array encoder that is in electronic communication with the digital signal processor;

(iv) a wireless transmitter that is in electronic communication with the field programmable gate array encoder; and (v) a transmitter control interface that comprises a microcontroller and that is in electronic communication with one or more of the audio digital encoder, digital signal processor, field programmable gate array encoder and wireless transmitter;

(c) a remote circuit subset comprising:

(i) a wireless receiver that is in wireless communication with the proximate circuit subset's wireless transmitter along an over-the-air path;

(ii) a field programmable gate array decoder that is in electronic communication with the wireless receiver;

(iii) a digital audio CODEC that is in electronic communication with the field programmable gate array decoder;

(iv) a digital audio amplifier that is in electronic communication with the digital audio CODEC; and (v) a receiver control interface that comprises a microcontroller and that is in electronic communication with one or more of the wireless receiver, field programmable gate array decoder, digital audio CODEC and digital audio amplifier; and (d) an external audio apparatus that is in electronic communication with the digital audio amplifier of the remote circuit subset.

2. The complementary bifurcated circuit of claim 1, wherein the audio transducer is attached to a musical instrument and is configured to transform the instrument's musical sounds to an electrical analog signal, and wherein the audio digital encoder is configured to transform the analog signal to a sampled digital format having a plurality of binary bits suitable for further processing for audio fidelity optimization.

3. The complementary bifurcated circuit of claim 1, wherein the digital signal processor is programmed to serve as a digital 60 Hz notch filter for a sampled audio digital stream.

4. The complementary bifurcated circuit of claim 1, wherein the field programmable gate array encoder is programmed to modify a sampled audio digital stream by modifying its sound latency, adding digital timing information, and formatting the digital stream for wireless transmission.

5. The complementary bifurcated circuit of claim 1, wherein the wireless transmitter is configured to transform a sampled audio digital stream input to a wireless signal for receipt by the wireless receiver with high fidelity.

6. The complementary bifurcated circuit of claim 1, wherein either the wireless transmitter or wireless receiver may transmit or receive wireless signals.

7. The complementary bifurcated circuit of claim 1, wherein the field programmable gate array decoder is programmed to modify a sampled audio digital stream by removing its formatting for wireless transmission.

8. The complementary bifurcated circuit of claim 1, wherein the digital audio CODEC is programmed in one or both of the following ways:

(a) the digital audio CODEC is programmed to modify a sampled audio digital stream's binary audio intensity in specific incremental audio frequency bands, to render the binary audio intensity essentially equal across the entire audio spectrum; or (b) the digital audio CODEC is programmed to insert a programmed delay in a sampled audio digital stream by routing the stream in a reiterative loop between an electronic output and electronic input of the CODEC until the stream reaches a desired degree of latency.

9. The complementary bifurcated circuit of claim 1, wherein the digital audio amplifier is programmed to increase the coded sound intensity of a sampled audio digital stream to provide sufficient audio power to drive one or more loud speakers at a desired volume of sound.

10. The complementary bifurcated circuit of claim 1, wherein one or both of the Transmitter Control Interface and the Receiver Control Interface have microcontroller control parameters that are adjustable by a human operator.

11. The complementary bifurcated circuit of claim 1, wherein the audio transducer is located in close proximity to a stringed instrument.

12. The complementary bifurcated circuit of claim 1, wherein the proximate circuit subset is integrated into the construction of an acoustic or electric guitar.

13. The complementary bifurcated circuit of claim 1, wherein the external audio apparatus is selected from the group consisting of an amplifier, a loudspeaker, a mixing board, a recording device, and head phones.

14. A complementary bifurcated circuit to process music digitally with high fidelity, wherein the circuit comprises:

(a) an audio transducer that is located in close proximity to a performing instrument or a vocalist's mouth, and that is configured to transform audible music into analog electrical signals;

(b) a proximate circuit subset comprising:

(i) an audio digital encoder that is in electronic communication with the audio transducer, and that is configured to transform analog electrical signals into digital electrical signals;

(ii) a digital signal processor that is in electronic communication with the audio digital encoder, and that is programmed to serve as a notch filter for a sampled audio digital stream to sharply attenuate the amplitude of frequency ranges associated with alternating current from power sources and to filter out unwanted internally generated noise from the instrument;

(iii) a field programmable gate array encoder that is in electronic communication with the digital signal processor, and that is programmed to optimize a sampled audio digital stream by modifying its sound latency, adding digital timing information, and formatting the digital stream for wireless transmission;

(iv) a wireless transmitter that is in electronic communication with the field programmable gate array encoder, and that is configured to transform a sampled audio digital stream input to a wireless signal for high fidelity reception by a wireless receiver; and (v) a transmitter control interface that comprises a microcontroller, and that is in electronic communication with and provides programming and control for each of the audio digital encoder, digital signal processor, field programmable gate array encoder and wireless transmitter;

(c) a remote circuit subset comprising:

(i) a wireless receiver that is in wireless communication with the proximate circuit subset's wireless transmitter along an over-the-air path;

(ii) a field programmable gate array decoder that is in electronic communication with the wireless receiver, and that is programmed to modify a sampled audio digital stream by removing its formatting for wireless transmission;

(iii) a digital audio CODEC that is in electronic communication with the field programmable gate array decoder, and that is programmed in one or both of the following ways:

(A) the digital audio CODEC is programmed to modify a sampled audio digital stream's binary audio intensity in specific incremental audio frequency bands, to render the binary audio intensity essentially equal across the entire audio spectrum; or (B) the digital audio CODEC is programmed to insert a programmed delay in a sampled audio digital stream by routing the stream in a reiterative loop between an electronic output and electronic input of the CODEC until the stream reaches a desired degree of latency;

(iv) a digital audio amplifier that is in electronic communication with the digital audio CODEC, and that is programmed to increase the coded sound intensity to a level desired for an external audio apparatus that is in line with the remote circuit subset; and (v) a receiver control interface that comprises a microcontroller, and that is in electronic communication with and provides programming and control for each of the wireless receiver, field programmable gate array decoder, digital audio CODEC and digital audio amplifier; and (d) an external audio apparatus that is in electronic communication with the digital audio amplifier of the remote circuit subset.

15. The complementary bifurcated circuit of claim 14, wherein the audio transducer is attached to a musical instrument, and wherein the audio digital encoder is configured to transform the analog signal to a sampled digital format having a plurality of binary bits suitable for further processing for audio fidelity optimization.

16. The complementary bifurcated circuit of claim 14, wherein the digital signal processor is programmed to serve as a digital 60 Hz notch filter for a sampled audio digital stream.

17. The complementary bifurcated circuit of claim 14, wherein either the wireless transmitter or wireless receiver may transmit or receive wireless signals.

18. The complementary bifurcated circuit of claim 14, wherein one or both of the Transmitter Control Interface and the Receiver Control Interface have microcontroller control parameters that are adjustable by a human operator.

19. The complementary bifurcated circuit of claim 14, wherein the proximate circuit subset is integrated into the construction of an acoustic or electric guitar.

20. The complementary bifurcated circuit of claim 14, wherein the external audio apparatus is selected from the group consisting of an amplifier, a loudspeaker, a mixing board, headphones, and a recording device.

* * * * *